US010184478B2

(12) United States Patent
Lai

(10) Patent No.: US 10,184,478 B2
(45) Date of Patent: Jan. 22, 2019

(54) FAN DEVICE WITH MODULAR FUNCTIONALITY

(71) Applicant: IN WIN DEVELOPMENT, INC., Taoyuan Hsien (TW)

(72) Inventor: Wen-Hsien Lai, Taoyuan Hsien (TW)

(73) Assignee: IN WIN DEVELOPMENT, INC., Taoyuan Hsien (TW)

( * ) Notice: Subject to any disclaimer, the term of this patent is extended or adjusted under 35 U.S.C. 154(b) by 351 days.

(21) Appl. No.: 15/153,683

(22) Filed: May 12, 2016

(65) Prior Publication Data

US 2017/0331346 A1 Nov. 16, 2017

(51) Int. Cl.
*F04D 25/06* (2006.01)

(52) U.S. Cl.
CPC ..... *F04D 25/0693* (2013.01); *F04D 25/0613* (2013.01)

(58) Field of Classification Search
CPC .. F04D 25/0693; F04D 13/0693; H02K 5/225
See application file for complete search history.

(56) References Cited

U.S. PATENT DOCUMENTS 6,795,314 B1 * 9/2004 Arbogast ..... H05K 7/20172 165/104.33
7,920,381 B2 * 4/2011 Kitahara ..... A61B 8/546 165/104.33
2011/0255238 A1 * 10/2011 Tan ..... G06F 1/183 361/679.48
2014/0029191 A1 * 1/2014 Terwilliger ..... G06F 1/20 361/679.31
2017/0314777 A1 * 11/2017 Lai ..... F21V 33/0096

* cited by examiner

*Primary Examiner* — Dang Le
(74) *Attorney, Agent, or Firm* — Pro-Techtor International Services; Ian Oglesby

(57) ABSTRACT

The present invention relates to a fan device with modular functionality, whereby an output end and input end of the fan are respectively provided with terminal joints. Two connector joints on the I/O module connecting wires are connected respectively to the terminal joints of the output end and the input end of the fan. Therefore, the output/input terminals are modularized by means of the separated wires to reduce the problems of wire trimming.

2 Claims, 2 Drawing Sheets

FAN DEVICE WITH MODULAR FUNCTIONALITY

BACKGROUND OF THE INVENTION a) Field of the Invention

The present invention relates to a fan device of which the I/O terminal is connected by a modular method to reduce the possibility of wire trimming, and to provide the fan with a characteristic of linking multiple fans through a modular method.

b) Description of the Prior Art

When a heat dissipation device, such as a fan is installed, they are typically connected with electrical wires. The wiring becomes more complex when the number fans are added. Referring to conventional fans 100, 200 and 300 in FIG. 3, input end 101 of fan 100 is installed throughout the whole electric wires 102, which the top end of electric wire 102 is provided with input terminal 103; and an input end 201 of fan 200 is installed throughout the whole electric wires 202, for which the top end of electric wire 202 is provided with input terminal 203. The above-mentioned fans 100 and 200 are connected to the power supply by input terminals 103 and 203.

However, when the number of the above-mentioned fans 100, 200 and 300 are increased, the electric wires 102 and 202 will become more complicated. Further, the electric wires 102 and 202 can only be installed successfully after neatly integrating all wires. Therefore, the installation will become difficult and more time consuming. Besides, the above-mentioned fans 100, 200 and 300 do not have the functionality of linked modular connection.

SUMMARY OF THE INVENTION

The primary objective of the present invention is to provide a fan device of which the dedicated I/O modular connecting wires are linked respectively in the input end and the output end of the fan. The modular functionality can reduce the possibility of wire trimming, and provide the present invention with the functionality of modularization; therefore, the efficiency of the products can be improved.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
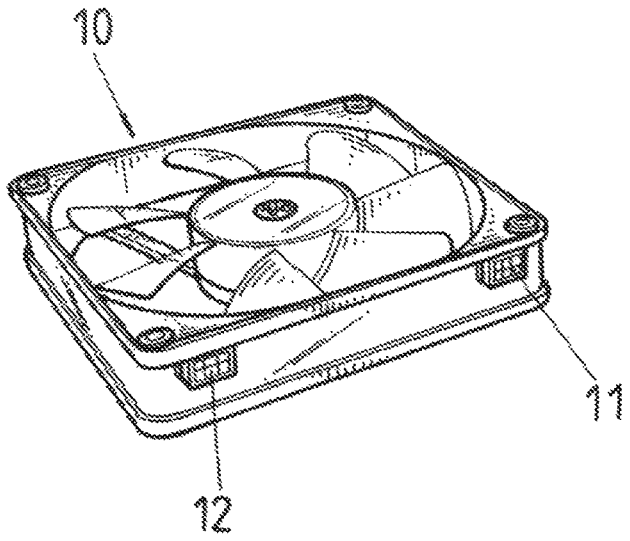
FIG. 1 shows a schematic view of the present invention.

Referring to FIG. 1, which shows a schematic view of the external appearance of the present invention, the output of the end of single fan 10 has a terminal joint 11, the input of the other end of fan 10 also has a terminal joint 12.

Figure 2:
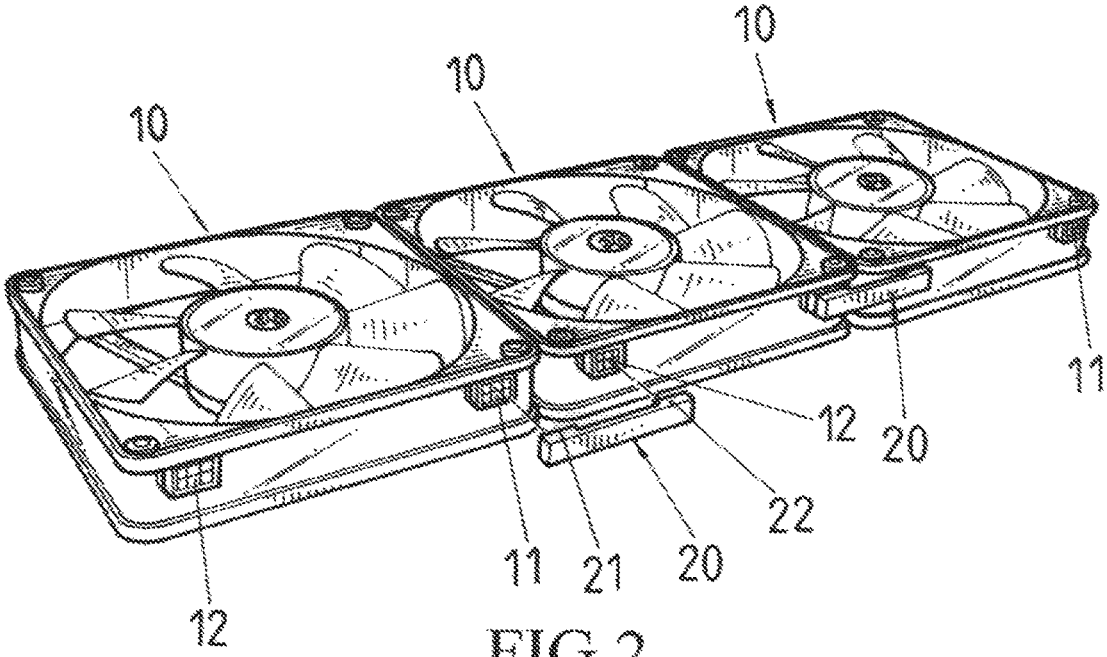
FIG. 2 shows a schematic view of the fans that are connected by a way of linking the fans to the present invention.
Figure 3:
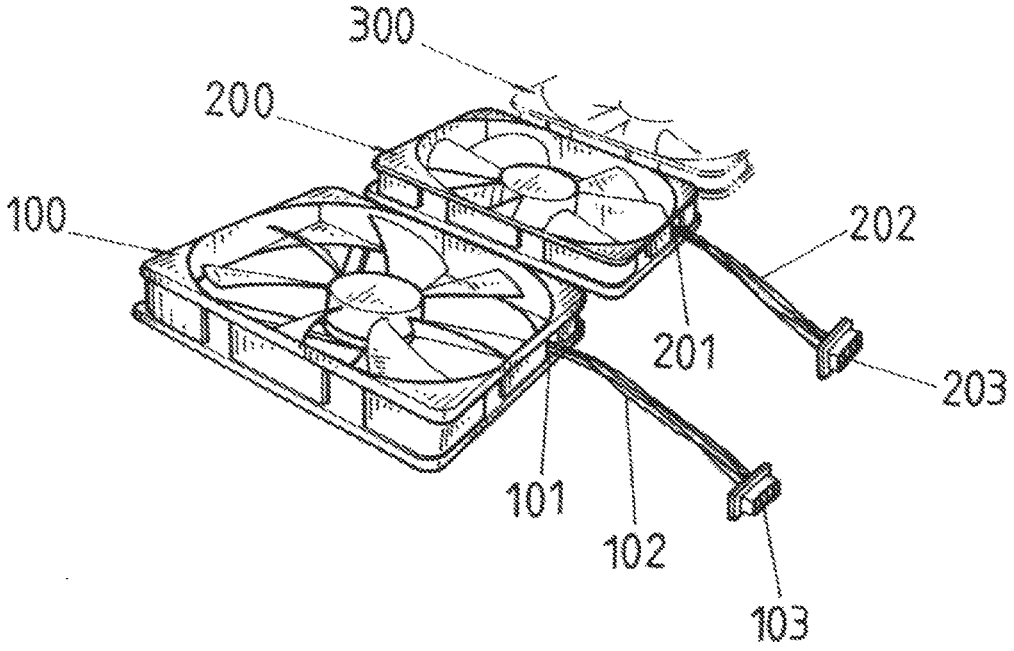
FIG.3( PRIOR ART )
FIG. 3 shows a schematic view illustrating actions of the prior art.

Referring to FIG. 2, the fans of the present invention are connected together, and fans 10 are linked to each other. I/O modular connecting wires 20 of an output/input terminal is mainly applied; wherein two connector joints 21 and 22 are installed inside the I/O modularized connecting wires 20 to input the two terminal joints 11 and 12 respectively and conveniently linking together multiple fans 10. Hence, the present invention reduces the necessity of wire trimming, and also helps to improve the cable management.

In conclusion, the output/input terminal are modularized to achieve a simple effect of wire integration of the I/O modularized connecting wires, and to apply to fans to improve the appearance and product efficiency.

It is of course to be understood that the embodiments described herein are merely illustrative of the principles of the invention and that a wide variety of modifications thereto may be effected by person's skill level in the art without departing from the spirit and scope of the invention as set forth in the following claims.

What is claimed is:

1. A fan device with modular functionality, comprising: a terminal joint on an output of one end of a fan; a terminal joint on an input of another end of the fan; and I/O module connecting wires for connecting the fan; wherein two connector joints are mounted inside the I/O module connecting wires, and are connected respectively to the two terminal joints of the fan.

2. The fan device with modular functionality according to claim 1, wherein the fans are linked together.

* * * * *